US009236693B2

(12) United States Patent
Pianezze

(10) Patent No.: US 9,236,693 B2
(45) Date of Patent: Jan. 12, 2016

(54) DEVICE FOR CONNECTION OF A THERMOCOUPLE TO A SAFETY ELECTROMAGNET AND GAS TAP ASSEMBLY IN A COOKING RANGE

(75) Inventor: Daniele Pianezze, Cassano Magnago (IT)

(73) Assignee: ILLINOIS TOOL WORKS INC., Glenview, IL (US)

( * ) Notice: Subject to any disclaimer, the term of this patent is extended or adjusted under 35 U.S.C. 154(b) by 42 days.

(21) Appl. No.: 14/236,895

(22) PCT Filed: Aug. 6, 2012

(86) PCT No.: PCT/IB2012/054012

§ 371 (c)(1),
(2), (4) Date: Feb. 3, 2014

(87) PCT Pub. No.: WO2013/021340

PCT Pub. Date: Feb. 14, 2013

(65) Prior Publication Data

US 2014/0162495 A1 Jun. 12, 2014

(30) Foreign Application Priority Data

Aug. 5, 2011 (IT) ..... TO2011A0738

(51) Int. Cl.
*H01R 11/22* (2006.01)
*H01R 24/38* (2011.01)
(Continued)

(52) U.S. Cl.
CPC ..... *H01R 24/38* (2013.01); *H01R 13/193* (2013.01); *H01R 13/639* (2013.01); *F23N 2900/05005* (2013.01); *H01R 2103/00* (2013.01)

(58) Field of Classification Search
CPC ..... H01R 2103/00; H01R 13/111; H01R 13/113; H01R 9/091; H01R 13/11
USPC ..... 439/578, 851–855
See application file for complete search history.

(56) References Cited

U.S. PATENT DOCUMENTS 5,562,506 A * 10/1996 Wright ..... 439/675
6,099,350 A * 8/2000 Wright ..... 439/582
(Continued)

FOREIGN PATENT DOCUMENTS

DE 19908469 A1 9/2000
EP 0619460 A1 10/1994
(Continued)

OTHER PUBLICATIONS

ISR and WO for PCT/IB2012/054012 mailed Nov. 20, 2012.
(Continued)

*Primary Examiner* — Thanh Tam Le
(74) *Attorney, Agent, or Firm* — Hauptman Ham, LLP

(57) ABSTRACT

A device for connection of a thermocouple to a coaxial connector of an electromagnet/gas tap assembly including a tubular body made of a non-conducting material and having a first end accommodating a female contact adapted to couple in use with a male tip contact of the coaxial connector; an electrically conducting and elastically deformable connecting element externally carried in cantilever fashion by a central portion of the tubular body so as to at least partly surround the first end of the tubular body and shaped so as to surround with radial clearance a collar of the coaxial connector when the female contact couples with the male tip contact; and a fastening element swingingly carried by the tubular body and that can be received on the connecting element for radially clamping the same onto the collar.

10 Claims, 4 Drawing Sheets

(51) Int. Cl.

| | |
|---|---|
| ***H01R 13/193*** | (2006.01) |
| ***H01R 13/639*** | (2006.01) |
| *H01R 103/00* | (2006.01) |

(56) References Cited

U.S. PATENT DOCUMENTS

| | | | | |
|---|---|---|---|---|
| 7,481,673 | B1 * | 1/2009 | Qu et al. | 439/578 |
| 8,221,161 | B2 * | 7/2012 | Leibfried, Jr. | 439/578 |
| 8,323,054 | B2 * | 12/2012 | Igarashi et al. | 439/578 |
| 8,727,807 | B2 * | 5/2014 | Sykes et al. | 439/578 |
| 8,961,224 | B2 * | 2/2015 | Grek et al. | 439/578 |
| 2011/0059650 | A1 | 3/2011 | Amidon | |

FOREIGN PATENT DOCUMENTS

| | | | |
|---|---|---|---|
| JP | 06251833 | A | 9/1994 |
| WO | 03/085324 | A1 | 10/2003 |
| WO | 2004/088205 | A1 | 10/2004 |

OTHER PUBLICATIONS

Italian Search Report for TO20110738 mailed Jun. 26, 2012.

* cited by examiner

DEVICE FOR CONNECTION OF A THERMOCOUPLE TO A SAFETY ELECTROMAGNET AND GAS TAP ASSEMBLY IN A COOKING RANGE

RELATED APPLICATIONS

The present application is U.S. National Phase of International Application Number PCT/IB2012/054012 filed Aug. 6, 2012, which claims priority to Italian Application Number TO2011A000738 filed Aug. 5, 2011.

TECHNICAL FIELD

The present invention relates to a device for connection of a thermocouple to a safety electromagnet-gas tap assembly in a cooking range of a household appliance.

BACKGROUND ART

It is known that in modern cooking ranges, for safety reasons, each burner of the cooking range is provided, usually next to the switching on electrode, with a thermocouple intended for controlling the safety solenoid valve of the gas tap coupled with the burner.

The thermocouples normally used for such task have an electrically conducting body fixed to the burner plate and which at a first end carries a tip provided with the so-called "hot junction" of the thermocouple, intended to remain in use immersed in the flame generated by the fire. A polarity wire and a ground or earth wire branch off the opposite end of the body, at the terminals of which an electro-motive force is generated in use, until the hot junction remains immersed in the flame, which keeps an electromagnet of the gas tap energized, allowing the gas supply to continue. If the flame goes off, the electromotive force stops and the electromagnet interrupts the gas supply.

The electromagnet that controls the gas supply forms an integrated assembly with the gas tap which, in most cases, is provided with a coaxial connector integrally obtained with the gas tap body; the coaxial connector has a male tip connector which is connected to a pole of the electromagnet, and a metal and conducting collar which surrounds the tip and which, through the same gas tap body, is connected to the other pole of the electromagnet.

According to EP0619460, the two thermocouple wires are connected to the electromagnet to supply it, through a coaxial connector complementary to that of the electromagnet/gas tap assembly and comprising a tubular head made of a non-conducting material wherein a female terminal is accommodated, connected to the polarity wire and adapted to couple with the male tip connector and around which a metal sleeve is supported with a radial clearance, connected to the ground wire and adapted to be interference fitted on the collar of the gas tap body that surrounds the tip.

An alternative solution is described in WO2004/088205, which teaches to connect the thermocouple wires with the coaxial connector provided on the electromagnet/gas tap assembly by means of a device comprising a tubular head of a non-conducting material which internally supports a female connector intended to couple with the tip and connected to the polarity wire and which laterally supports on the outside a slide made of conducting material and connected to the ground wire, which after the insertion of the female connector onto the tip can be made to slide transversally to the tip, through a side window of the head, until it snap fits straddling the collar.

The solutions described have some drawbacks. The connector of EP0619460 has a high insertion and disconnection force; moreover, it is very expensive as it must be made with relatively small tolerances, otherwise it would either be impossible to assemble or a poor electrical contact would be obtained which, even if it does not make the thermocouple work bad, increases the response time thereof due to the raising of the electrical resistance. The connector device of WO2004/088205 has a complex and expensive construction and, above all, has large overall dimensions when the slide protrudes laterally from the head. Moreover, the operator in charge of the assembly can insert the slide in operating position, inside the head, before inserting the female connector onto the tip; this improper use does not usually prevent the assembling by simple insertion of the head/female connector/slide assembly on the coaxial connector provided on the electromagnet/gas tap assembly but it usually causes the onset of a poor electric contact (with possible damage to the slide) which therefore extends the response times of the thermocouple. Finally, connectors of this type are not suitable for relatively frequent assembly/removal.

DE 19908496 does not overcome any of these drawbacks. In fact, the male coaxial connector is interference inserted into the female coaxial connector, the sleeve contact whereof is provided with notches and can therefore be "opened" to facilitate the insertion and reduce the insertion effort. On the other hand, the retaining force is low; for this reason, an annular ridge is provided on the female connector and an annular recess is provided on the male connector; in the insertion step, the annular ridge engages the recess allowing the sleeve contact to "close"; thereafter, a ring or retaining element is axially moved which surrounds the sleeve contact on the outside to prevent it from opening, thus keeping the ridge permanently engaged into the relative recess. If on the one side this solution reduces the insertion effort of the male connector into the female connector, it does not ensure a good electric contact and make the connector construction much more complex, since elements (annular ridge and recess) to be coupled need to be obtained. Moreover, the connector overall dimensions are greatly increased both in axial and in radial direction.

DISCLOSURE OF INVENTION

It is an object of the present invention to overcome such drawbacks by providing a device for connection of a thermocouple to a safety electromagnet and gas tap assembly which allows relatively fast response times of the thermocouple associated with a relatively low cost and overall dimensions of the device as well as an easy construction and assembly of the same. All also ensuring an optimal electric contact and the possibility of carrying out repeated assembly/removal operations without damaging the device.

The present invention therefore relates to a device for connection of a thermocouple to a safety electromagnet and gas tap assembly in a cooking range of a household appliance as defined in claim 1.

The connector device according to the invention comprises a tubular body made of a non-conducting material and having a first end accommodating a female contact therein, connectable to a polarity wire of the thermocouple and adapted to be coupled in use with the male tip contact of the coaxial connector of the electromagnet and gas tap assembly, when the first end is inserted within the connector collar; and an electrically conducting connecting element connectable to the ground wire of the thermocouple and carried radially on the outside of a central portion of the tubular body immediately adjacent the first end. The connecting element axially protrudes in cantilever fashion from such central portion parallel to the first end so as to at least partly surround it.

According to the main aspect of the invention, the connecting element is shaped so as to circumferentially surround, with predetermined radial clearance, at least a part of the collar of the coaxial connector when the female contact couples with the male tip contact and at the same time, so as to be elastically deformable in radial direction, radially inwards. Moreover, according to the invention, the connector device comprises a fastening element made of a non-conducting material and movably carried by the tubular body between a stand-by or resting position, wherein it does not cooperate with the connecting element, and a working position, wherein the fastening element is received on the connecting element for radially clamping the same towards the first end of the tubular body and by such an extent that, in use, when the female contact couples with the male tip contact, the connecting element mechanically and electrically couples in contact with the collar. Clearly, the fastening element is shaped so that, when it is in the working position, it at least partly embraces the connecting element and so as to have internal transversal dimensions smaller than the external transversal dimensions of the connecting element.

In this way, if an operator moves the fastening element to the working position before inserting the female contact of the device on the male contact of the coaxial connector of the electromagnet and gas tap assembly, the subsequent coupling is made impossible, thus preventing incorrect assembly. On the other hand, if the assembly is correctly made, the insertion of the device according to the invention onto the coaxial connector requires a very low effort, i.e. only that needed to insert the female contact on the male tip contact and optionally, the first end of the tubular body into the collar, if such first end is advantageously made as a plurality of elastically deformable arms defining a cylindrical sleeve segment having a slightly larger diameter than the inner collar diameter.

When the fastening element is then moved to the working position, it radially closes the connecting element towards the symmetry axis of the tubular body, eliminating the radial clearance initially present between connecting element and collar and, rather, applying a slight forcing of the mechanical and electric coupling which is thus created, thereby always ensuring an optimal coupling, which has a low electric resistance and thus provides reduced response times for the thermocouple. Finally, there are no risks of extraction of the device after its coupling on the coaxial connector.

The above advantages are further ensured by the construction of the fastening element as a circumferentially open cylindrical sleeve, forcedly fitted with a first end thereof on the central portion of the tubular body and protruding in cantilever fashion with a second end thereof around just one first segment of the first end of the tubular body, such second end of the fastening element comprising a plurality of elastically deformable, cantilevered axial arms.

BRIEF DESCRIPTION OF THE DRAWINGS

Further features and advantages of the present invention will appear clearly from the following description of a preferred embodiment thereof, made by way of a non-limiting example and with reference to the annexed drawings, wherein.

BEST MODE FOR CARRYING OUT THE INVENTION

Figure 1:
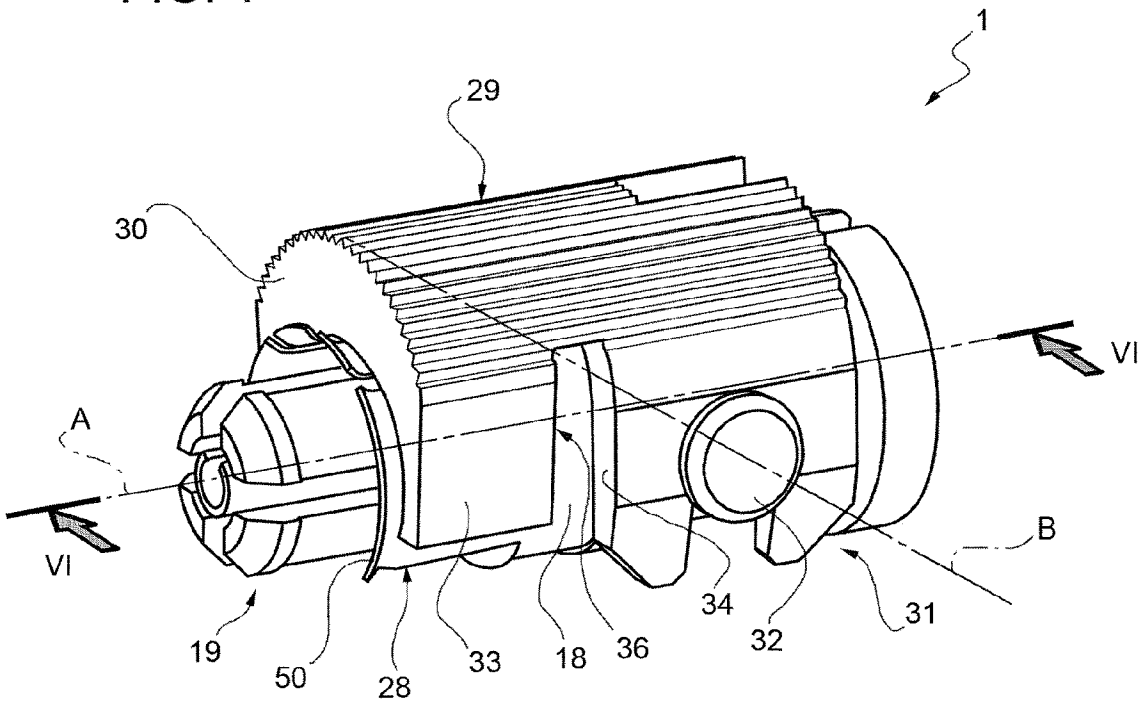
FIG. 1 shows a perspective three-fourth front view of a device for connection of a thermocouple to a safety electromagnet-gas tap assembly made according to the invention.
Figure 2:
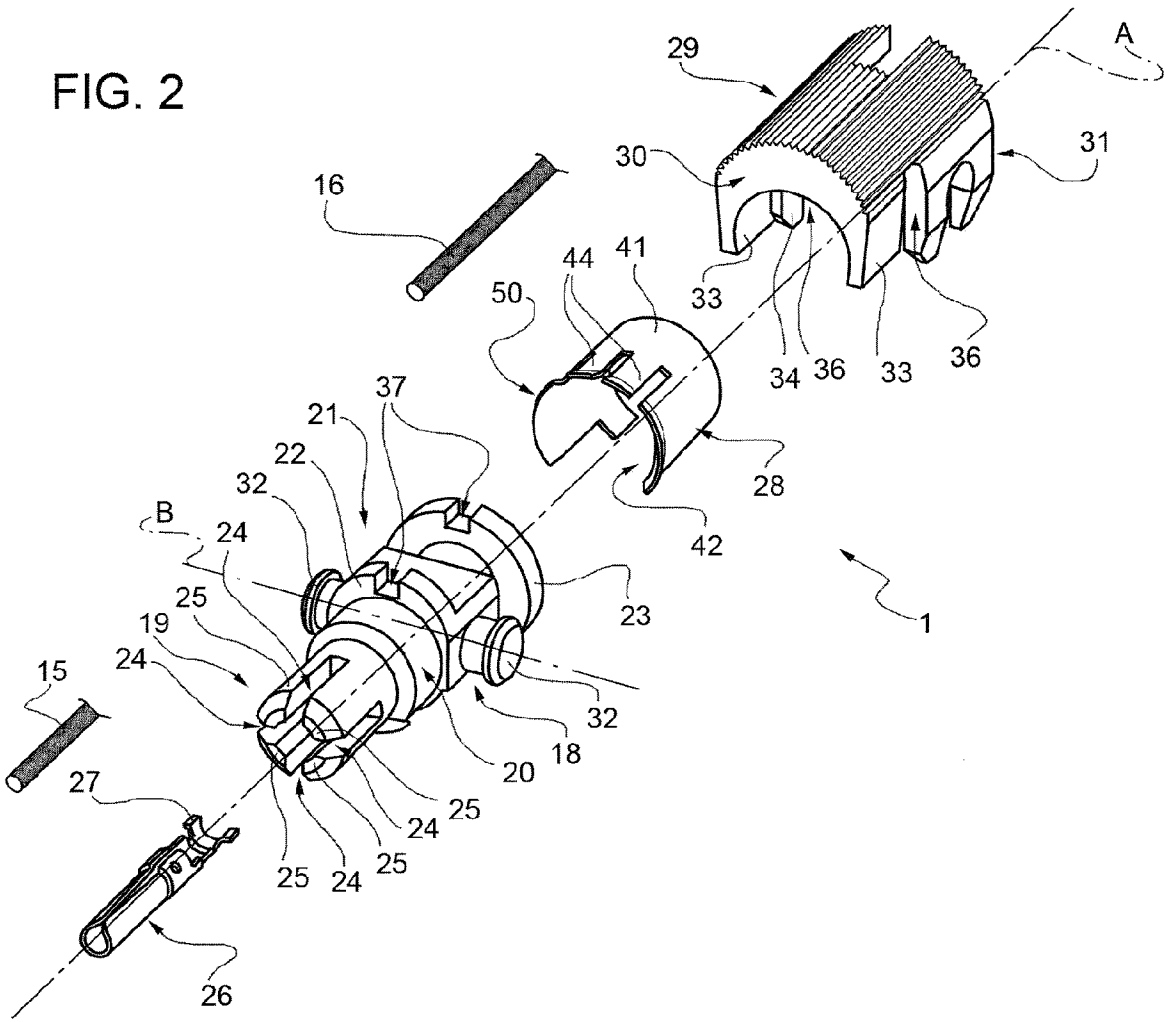
FIG. 2 shows an exploded perspective view of the connector device of FIG. 1.
Figure 6:
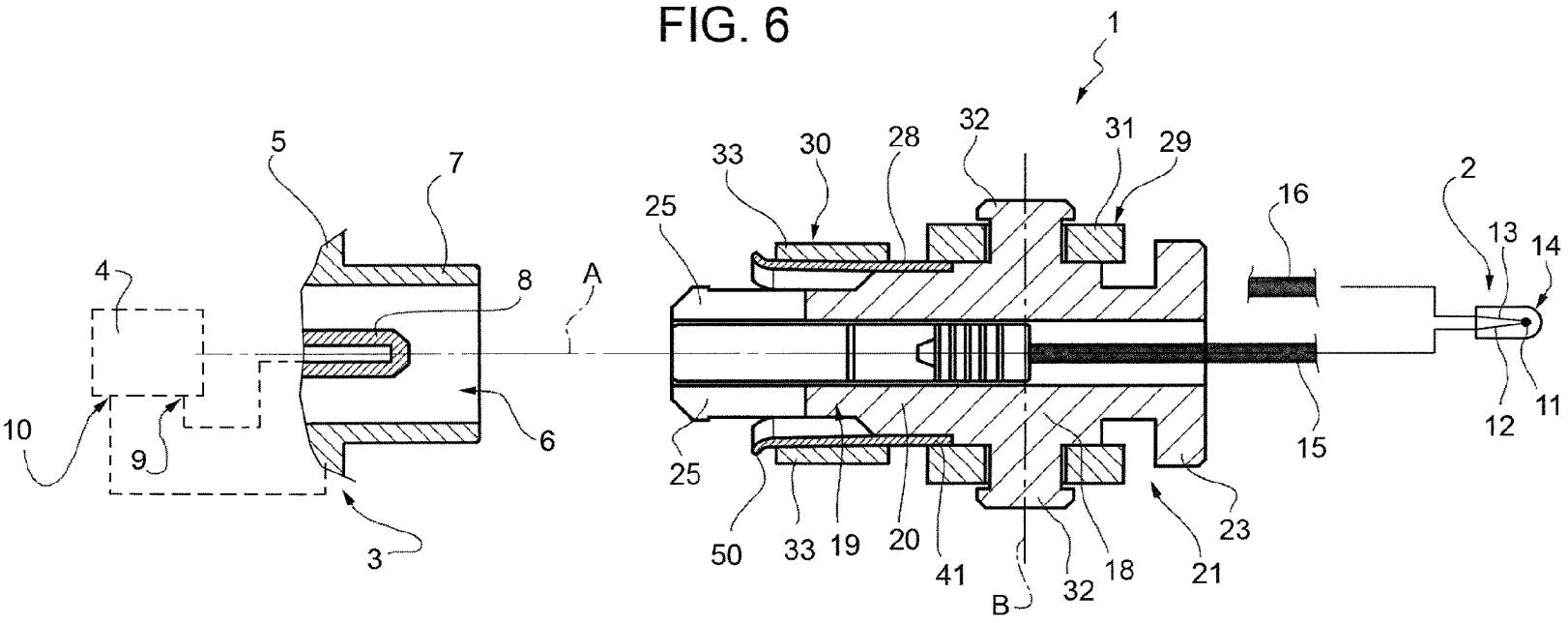
FIG. 6 shows a longitudinal section view of the device of FIG. 1 and, schematically, the mode of use thereof.

With reference to FIGS. 1, 2 and 6, reference numeral 1 globally indicates a device for connecting, in a cooking range of a household appliance, known and not shown for simplicity, a thermocouple 2 (FIG. 6) to an assembly consisting of a safety electromagnet 4 (known and for simplicity only shown as a dashed line block) and of a gas tap 5, also known, whereof only a part of a body is shown, provided with a coaxial connector 6 wherethrough the connection with thermocouple 2 is made as will be seen, by means of device 1 according to the invention.

In particular, the coaxial connector 6 comprises a conducting collar 7 within which a male tip contact 8 is arranged; contact 8 is connected to a pole 9 of electromagnet 4, whereas collar 7 is connected through the body of the gas tap 5 to a pole 10 of electromagnet 4. Thermocouple 2, only schematically shown (FIG. 6), comprises a hot junction 11 formed by the welding of two elements 12, 13 made of two different metal alloys (typically NiCr9010 and constantan) and is part of a tip 14 intended in use to remain immersed in the flame the switch on whereof has to be controlled, and which may constitute one of elements 12, 13 (that in NiCr9010 alloy). Thermocouple 2 is completed by a polarity wire 15 and by a ground or earth wire 16, connected to elements 12 and 13 and both connected as will be seen to the connection device 1, which in this way is also part of thermocouple 2.

The connection device 1 comprises a tubular body 18 made of a non-conducting material, typically by molding of a synthetic plastic material, and having a generally cylindrical symmetry, having a symmetry axis A which in use coincides with the symmetry axis of the coaxial connector 6.

The tubular body 18 comprises a first end 19, a central portion 20, also cylindrical but with larger outer diameter than that of end 19, and a second end 21, opposite to end 19, partly having a prismatic outer shape and delimited between two flanges 22 and 23 which extend radially on the outside of the tubular body 18, which is therefore provided with the pair of flanges 22 and 23 on the side opposite to end 19: in particular, flange 22 separates end 21 from the central portion 20 and flange 23 defines the end edge of end 21.

According to an aspect of the invention, end 19 consists of a cylindrical sleeve segment having a smaller diameter than the transversal dimensions of the rest of the tubular body 18, but slightly larger than the inner diameter of collar 7 with which end 19 is intended to couple, in this case by slight forcing. In order to limit the required insertion force, such cylindrical sleeve segment defining end 19 is divided by a plurality of radial slots 24 into a plurality of elastically deformable longitudinal arms 25 which axially extend in cantilever fashion from the central portion 20.

End 19 further accommodates a female contact 26 therein, per se known, connectable to the polarity wire 15 of thermocouple 2 and adapted to couple in use with contact 8; contact 26 is made by folding a metal foil as a cylinder and is connected to cable 15 by means of a clamp end thereof 27 which is plastically deformed clamping it onto the end of wire 15.

Thanks to the structure described, end 19 is shaped so as to be adapted to be inserted in use within collar 7 of the coaxial connector 6 for determining the coupling of the female contact 26 with the male tip contact 8 accordingly. The fact that the coupling between the cylindrical sleeve segment defining end 19 and collar 7 takes place in a slightly forced manner, associated to the fact that such cylindrical sleeve segment is longitudinally slotted through slots 24, not only keeps the insertion force of end 19 into collar 7 relatively low, as already said, but above all, with the insertion, it produces a radial bend of arms 25 towards axis A which moves the same to radially press the side wall of the female contact 26 against contact 8, drastically reducing the electrical resistance of the coupling.

Device 1 according to the invention further comprises an electrically conducting connecting element 28 connectable to the ground wire 16 of thermocouple 2 and radially carried on the outside of the central cylindrical portion 20 of the tubular body 18, which is immediately adjacent to end 19; the connecting element 28 is made, in the non-limiting example shown, as a cylindrical sleeve partially open in circumferential direction and axially protrudes in cantilever fashion from the central portion 20, towards and parallel to end 19 (FIGS. 1 and 6), so as to at least partly surround it.

According to the main feature of the invention, the connecting element 28 is shaped so as to be elastically deformable in radial direction towards its interior, i.e. towards axis A, and embraces with radial clearance and in circumferential direction at least a part of collar 7 of the coaxial connector 6 when the female contact 26 couples with the male tip contact 8. In this way, element 28 is moved adjacent to collar 7 by the insertion of end 19 into collar 7 itself but, contrary to the prior art devices, it is not mechanically or electrically coupled with collar 7. Therefore, its presence does not increase the already weak insertion force required for coupling end 19 of the tubular body 18 into collar 7 and, as a consequence, coupling the female contact 26 with the male contact 8.

Again according to the main feature of the invention, in combination with said shape and elasticity of element 28, the connecting device 1 also comprises a fastening element 29 made of a non-conducting material, typically by molding a synthetic plastic material, and movably carried by the tubular body 18 between a stand-by or resting position, not shown for simplicity, wherein it does not cooperate with the connecting element 28, and a working position, shown in FIGS. 1 and 6, wherein the fastening element 29 is received on the connecting element 28 for radially clamping the same towards end 19 by such an extent that, in use, when the female contact 26 is already coupled with the male tip contact 8, the connecting element 28 then mechanically and electrically couples in contact with collar 7, radially on the outside the same.

In particular, the fastening element 29 is swingingly carried by the second end 21 of the tubular body 18, transversally to the symmetry axis A of the tubular body 18, and so as to protrude in cantilever fashion from end 21 towards end 19 and so as to be adapted to intercept the connecting element 28 by means of a free end 30 thereof.

In the example shown, the fastening element 29 is shaped as a sleeve circumferentially open on one side by the entire length thereof and having symmetry axis coinciding with axis A of the tubular body 18 when the fastening element 29 is in the working position (FIGS. 1 and 6). Moreover, the fastening element has two opposite ends, end 30 and an end 31, the latter shaped as a dual fork, by which it is snappingly constrained on a pair of transversal pins 32 integrally obtained with end 21 between the two flanges 22 and 23 and defining a rotation axis B (FIG. 6) perpendicular to axis A, around which end 31 is free to rotate.

Thus, since the fastening element 29 is constrained by end 31 thereof to end 21 of body 18, it protrudes in cantilever fashion from end 21 and towards end 19 and end 30 thereof constitutes the free end of such cantilevered element. End 30 is preferably shaped as a C-shaped clamp in a plane perpendicular to axis A and has respective opposite arms 33 oriented slightly converging towards each other. Such arms 33 are defined by respective opposite circumferential portions of a side wall 34 of the fastening element 29, circumferential portions that are delimited towards axis B by a pair of opposite circumferential slots 36 which cut through the side wall 34 of the fastening element 29.

Flanges 22 and 23 serve as support and stopping elements for the fastening element 29, both when it is inclined with respect to axis A, in the stand-by position, and when it is in said working position. Flanges 22 and 23 are further provided with respective radial grooves 37 for receiving through the ground wire 16.

In summary, the fastening element 29 is shaped so that when it is in the working position, it at least partly embraces and surrounds the connecting element 28 and so as to have internal transversal dimensions smaller than the external transversal dimensions of the connecting element 28.

Figure 4:
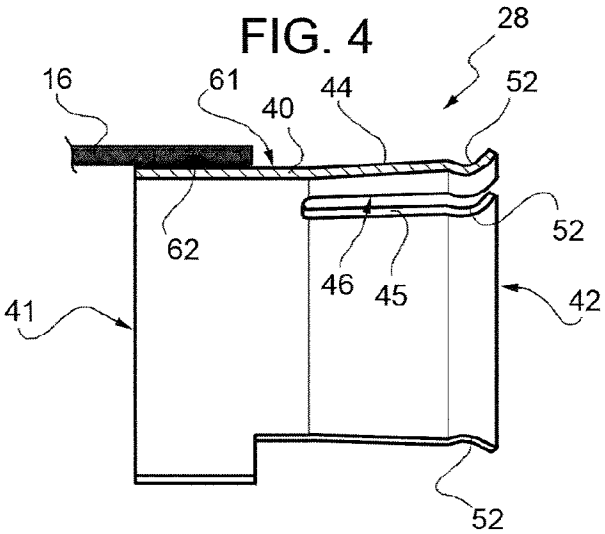
FIGS. 3, 4 and 5 show an enlarged scale view of a component of the connector device of FIGS. 1 and 2.
Figure 5:
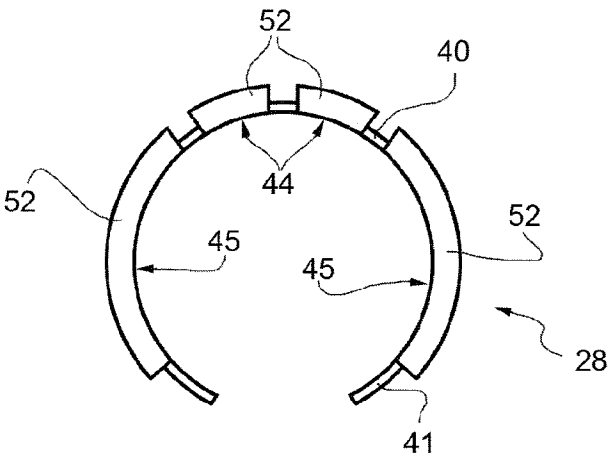
Figure 3:
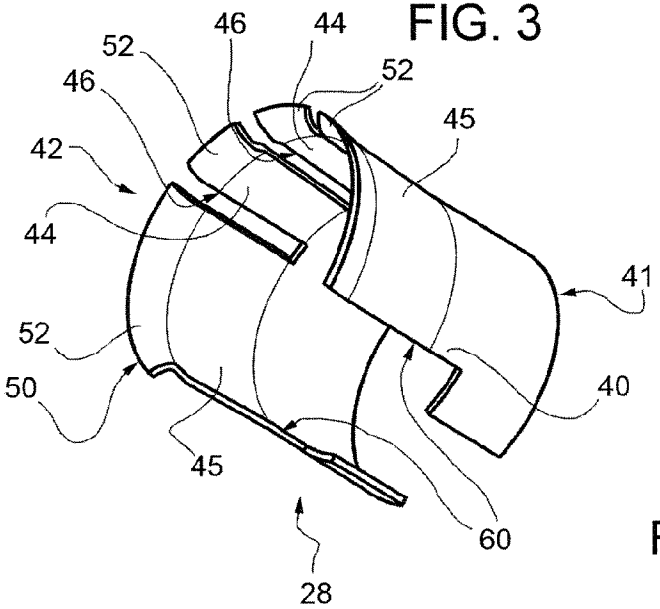

With reference to FIGS. 3-5, the connecting element 28 is defined by a sheared metal foil, folded to form a circumferentially open, cylindrical sleeve 40 which is coaxially mounted to the tubular body 18 by means of a first end 41 thereof, which is forcedly fitted onto the central portion 20. The connecting element 28 further has a second end 42, opposite to end 41, which axially extends in cantilever fashion, i.e. outstandingly, from the central portion 20 of the tubular body 18 and around a first axial segment only, immediately adjacent to portion 20, of end 19.

According to what required by the respective roles, end 41 of the connecting element 28 is circumferentially larger than end 42, since end 41 is intended for the steady fixing of element 28 on body 18.

End 41, as is well shown in FIG. 3, extends on a circumferential arc of at least 200° and preferably equal to about 240°, and is defined by a plurality of elastically deformable axial arms 44, 45, which are independent of each other and separated by respective sheared longitudinal slots 46 of the foil making up sleeve 40.

According to a feature of the invention, the axial arms 44, 45 have their free ends which define all together a terminal edge 50 of the second end of the connecting element, curved as an arch of a circle in the axial direction to form respective bulges 52 on arms 44, 45 (FIG. 4) which, on the side of a convexity thereof, radially extend towards the interior of the circumferentially open, cylindrical sleeve 40 defining the connecting element 28. Two arms 44 and two arms 45 are provided. The circumferential extension of arms 45, which are adjacent to two opposite longitudinal end edges 60 of the open sleeve 40, is greater than that of arms 44, which are circumferentially arranged between arms 45.

Thanks to the structure described, the connecting element 28 may be made of brass rather than phosphorus bronze; it is therefore possible to advantageously connect the ground wire 16, which is directly welded onto an outer side surface 61 of the connecting element 28, facing the opposite side of the tubular body 18, by means of one or more welding spots 62.

The described device 1 is very inexpensive and simple to make by separately making elements 18, 26, 28 and 29 and then assembling the same: the female contact 26 is then inserted into end 19, then the open tubular element 28 is fitted onto the cylindrical portion 20 and wires 15 and 16 are fastened; finally, the fastening element 29 is snappingly mounted onto pins 32 in a stand-by configuration.

Thermocouple 2 is then coupled with electromagnet 4 by inserting, as already described, end 19 into collar 7. At this point, the connection is not established yet. Element 29 must be rotated to the working position; it is inserted with the clamp shaped end 30 onto arms 44 and 45 of the connecting element 28, elastically bending them towards axis A and then, also thanks to the converging shape of arms 33, squeezing them pressure-wise against the outer side wall of collar 7. This not only establishes the electric continuity between wire 16 and collar 7, but also causes the pressure lock of device 1 onto collar 7, preventing any accidental movement, even in the presence of tensile stresses on wires 15, 16. Only by returning element 29 to the stand-by position it is possible to detach device 1 from collar 7 and then disconnect thermocouple 2.

The invention claimed is:

1. A device for connecting, in a cooking range of an electric household appliance, a thermocouple to an assembly consisting of a safety electromagnet and a gas tap by means of a coaxial connector of the assembly comprising a conducting collar within which a male tip contact is arranged; the device comprising: a tubular body made of non-conducting material and having a first end accommodating a female contact therein, the female contact connectable to a polarity wire of the thermocouple and adapted to be coupled in use with the male tip contact, said first end being shaped so as to be inserted in use into the collar of the coaxial connector to thus determine the coupling of the female contact to the male tip contact; and an electrically conducting connecting element which is configured to be connected to a ground wire of the thermocouple and carried radially on an outside of a central portion of the tubular body immediately adjacent to the first end, wherein the connecting element axially projects from the central portion of the tubular body in cantilever fashion parallel to the first end so as to at least partially surround the first end; characterized in that the connecting element is shaped so as to be elastically deformable in the radial direction and to circumferentially embrace with a radial clearance at least part of the collar of the coaxial connector when the female contact couples with the male tip contact; and in that, in combination, the device further comprises a fastening element made of a non-conducting material carried by the tubular body so as to be movable between a resting position, where the fastening element does not cooperate with the connecting element, and a working position, where the fastening element is located on the connecting element to radially close the connecting element towards the first end of the tubular body by such an amount that in use, when the female contact is coupled with the male tip contact, the connecting element is mechanically and electrically coupled with the collar.

2. A device according to claim 1, characterized in that said fastening element is swingingly carried by a second end of the tubular body, opposite to the first end and transversally to a symmetry axis (A) of the tubular body, in order to project in cantilever fashion from the second end towards the first end, and so as to be adapted to intercept the connecting element by means of a free end of the fastening element, when the fastening element is in the working position.

3. A device according to claim 2, characterized in that the free end of the fastening element is shaped as a C-shaped clamp, respective opposite arms of which are oriented so as to be slightly converging towards each other.

4. A device according to claim 3, characterized in that the fastening element is shaped as a sleeve which is circumferentially open on one side over the whole length of the fastening element and having the symmetry axis coinciding with that of the tubular body when the fastening element is in the working position; said arms being defined by respective opposite circumferential portions of a side wall of the fastening element, delimited towards a rotation axis of the fastening element by a pair of opposite circumferential slots which cut through the side wall of the fastening element.

5. A device according to claim 1, characterized in that the connecting element is defined by a sheared metal foil, folded to form a circumferentially open, and a cylindrical sleeve which is coaxially mounted to the tubular body by means of a first end thereof, which is forcibly fitted onto said central portion of the tubular body.

6. A device according to claim 5, characterized in that said connecting element has a second end, opposite to the first end, wherein the second end axially extends in cantilever fashion from the central portion of the tubular body and around a first axial segment only of the first end of the tubular body, the first end of the connecting element having longer circumferential extension than the second end; the latter extending on a circumferential arch by at least 200° and being defined by a plurality of elastically deformable, axial arms independent of one another and separated by respective longitudinal sheared slots of the foil.

7. A device according to claim 6, characterized in that said axial arms have respective free ends which define all together a terminal edge of the second end of the connecting element, curved as an arch of a circle in the axial direction to form respective bulges on the arms which, on the side of a convexity thereof, radially extend towards an interior of the circumferentially open, the cylindrical sleeve formed by said folded foil defining the connecting element.

8. A device according to claim 1, characterized in that said connecting element is made of brass; and in that said ground wire is directly welded onto an outer side surface of the connecting element, the outer side surface of the connecting element being located on an opposite side of the connecting element from a side that faces the tubular body.

9. A device according to claim 1, characterized in that said tubular body is provided with a pair of flanges on the side opposite to the first end of the tubular body, wherein the flanges radially extend outside the same, the pair of flanges acting as resting and stopping elements for the fastening element when the fastening element is in said working position, and are provided with respective radial grooves to receive the ground wire.

10. A device according to claim 1, characterized in that said first end of the tubular body consists of a segment of a cylindrical sleeve having a diameter smaller than a transversal dimensions of a portion of the tubular body other than the segment of the cylindrical sleeve and slightly larger than an inner diameter of the collar of the coaxial connector; said segment of a cylindrical sleeve being divided by a plurality of radial slots into a plurality of elastically deformable, longitudinal arms which axially extend in cantilever fashion from the central portion of the tubular body.

* * * * *